US007621372B2

(12) United States Patent
Yamaura et al.

(10) Patent No.: US 7,621,372 B2
(45) Date of Patent: Nov. 24, 2009

(54) DUCT AND PROCESS FOR PRODUCING THE SAME

(75) Inventors: Kunihiro Yamaura, Chita-gun (JP); Kouichi Oda, Chita (JP)

(73) Assignee: Toyota Boshoku Kabushiki Kaisha, Kariya-shi (JP)

( * ) Notice: Subject to any disclaimer, the term of this patent is extended or adjusted under 35 U.S.C. 154(b) by 156 days.

(21) Appl. No.: 11/755,289

(22) Filed: May 30, 2007

(65) Prior Publication Data

US 2007/0278034 A1 Dec. 6, 2007

(30) Foreign Application Priority Data

May 30, 2006 (JP) ..... 2006-150547

(51) Int. Cl.
*F02M 35/00* (2006.01)
*F02M 35/10* (2006.01)
*F01N 1/10* (2006.01)
*E04F 17/04* (2006.01)

(52) U.S. Cl. ..... 181/229; 181/224; 181/252; 96/134; 123/184.21

(58) Field of Classification Search ..... 181/229, 181/224, 252; 96/134; 123/184.21, 184.61
See application file for complete search history.

(56) References Cited

U.S. PATENT DOCUMENTS 6,386,317 B1 * 5/2002 Morohoshi et al. ..... 181/252
6,553,953 B1 * 4/2003 Fujihara et al. ..... 123/184.21
2001/0011448 A1 * 8/2001 Kino et al. ..... 55/385.3
2002/0029693 A1 * 3/2002 Sakakibara et al. ..... 96/134
2002/0129711 A1 * 9/2002 Oda et al. ..... 96/134

FOREIGN PATENT DOCUMENTS

| | | |
|---|---|---|
| JP | 56-41149 | 4/1981 |
| JP | 58-72669 | 4/1983 |
| JP | 10-180022 | 7/1998 |
| JP | 11-343938 | 12/1999 |
| JP | 11-343939 | 12/1999 |
| JP | 2000-73895 | 3/2000 |
| JP | 2002-4956 | 1/2002 |
| JP | 2002-115158 | 4/2002 |
| JP | 2003-35225 | 2/2003 |
| JP | 2003035225 A * | 2/2003 |
| JP | 2006-90252 | 4/2006 |

* cited by examiner

*Primary Examiner*—Jeffrey Donels
*Assistant Examiner*—Christina Russell
(74) *Attorney, Agent, or Firm*—Oblon, Spivak, McClelland, Maier & Neustadt, L.L.P.

(57) ABSTRACT

An object of the present invention is to provide a duct having a simple structure and capable of suppressing occurrences of an intake noise and a dropping-out of an adsorbent, and to a process for producing the same capable of producing easily. The present duct (1) is one comprising a duct body (2) in tubular, and the duct body (2) is comprised of a nonwoven fabric in which an adsorbent (3) in at least one type among granular, powdery and fibrous is disposed as an intermediate layer. The duct body (2) is preferably composed of a first fiber layer (7) located on an inner circumferential side, a second fiber layer (8) located on an outer circumferential side, and the adsorbent (10) is disposed between the first fiber layer (7) and the second fiber layer (8).

15 Claims, 3 Drawing Sheets

DUCT AND PROCESS FOR PRODUCING THE SAME

BACKGROUND OF THE INVENTION

1. Field of the Invention

The present invention relates to a duct and a process for producing the same. More specifically, it relates to a duct having a simple structure and capable of suppressing occurrences of an intake noise and a dropping-out of an adsorbent, and to a process for producing the same capable of producing easily.

2. Related Art

Conventionally, an intake duct provided with a fuel vapor absorption function so as to reduce an emitted fuel vapor outside the vehicle from a carburetor via an air cleaner when the vehicle engine is stopped, is disclosed, for example in JP-A S58-72669 and JP-U1 S56-41149.

However, according to JP-A S58-72669 above, a porous adsorbing layer is attached to an inner wall of a duct body such that a forming process of the duct body and a fixing process of the porous adsorbing layer must be carried out separately. Further, according to JP-U1 S56-41149, a container accommodating a fuel vapor adsorbing layer is attached to an opening part that is formed on an outer circumferential side of a duct body, such that the duct itself must be made large and a relatively large installation space in an engine compartment is necessary. In addition, though a trapping wall is provided on the lower portion of the inner wall of the duct body for trapping a fuel vapor with a relatively higher density than that of air, the trapping wall sometimes leads to an increased suction resistance of an outdoor air and to a reduced engine power. Moreover, a forming process of the duct body and a fixing process of the porous adsorbing layer must be carried out separately in a manner substantially similar to the case in JP-A S58-72669.

Thus, an intake duct formed from a nonwoven fabric comprising an adsorbent for solving the problems above is proposed, for example in JP-A 2006-90252.

JP-A 2006-90252 above discloses a production method comprising production steps for a nonwoven fabric with an adsorbent dyed fiber and for a duct using the nonwoven fabric, successively. Additionally, a production method comprising a manufacturing process for a nonwoven fabric and a coating process where an adsorbent is coated on the duct.

According to the former method, since an adsorbent dyed fiber is used, it is difficult to adhere these fibers together. Therefore, in this method, the duct is formed by fulling the nonwoven fabric disposed on an outer circumference of a wire. Further, according to the latter method, since the adsorbent is coated, there may be a case where permeability is inhibited and a case where the adsorbent is removed from a fiber of the nonwoven fabric due to a long-term use.

SUMMARY OF THE INVENTION

Problems to be Solved by the Invention

An object of the present invention is to provide a duct having a simple structure and capable of suppressing occurrences of an intake noise and a dropping-out of an adsorbent, and to a process for producing the same capable of leading to easily production.

Means for Solving Problem

The present invention is described as follows.

1. A duct comprising a duct body in tubular,
   wherein the duct body is comprised of a nonwoven fabric in which an adsorbent in at least one type among granular, powdery and fibrous is disposed as an intermediate layer.
2. The duct according to 1 above,
   wherein the duct body comprises a first fiber layer that is located on an inner circumferential side of the duct body, a second fiber layer that is located on an outer circumferential side of the duct body, and the adsorbent that is disposed between the first fiber layer and the second fiber layer.
3. The duct according to 2 above,
   wherein a mass per unit area of a first fiber-integrated body constituting the first fiber layer is less than a mass per unit area of a second fiber-integrated body constituting the second fiber layer.
4. The duct according to 3 above,
   wherein a ratio of the mass per unit area of the first fiber-integrated body to the mass per unit area of the second fiber-integrated body is in the range from 0.025 to 0.5.
5. The duct according to 2 above,
   wherein the duct body is an integrated article of half-split molded articles consisting of the first fiber layer, the second fiber layer and the adsorbent.
6. The duct according to 5 above,
   wherein a mass per unit area of a first fiber-integrated body constituting the first fiber layer is less than a mass per unit area of a second fiber-integrated body constituting the second fiber layer.
7. The duct according to 6 above,
   wherein a ratio of the mass per unit area of the first fiber-integrated body to the mass per unit area of the second fiber-integrated body is in the range from 0.025 to 0.5.
8. The duct according to 1 above,
   wherein the adsorbent comprises an activated carbon.
9. The duct according to 1 above,
   wherein the duct is an intake duct that admits an outdoor air into an air cleaner for a vehicle.
10. A process for producing a duct having a duct body in tubular, comprising successively:
    step (I) for obtaining a nonwoven fabric in which an adsorbent in at least one type among granular, powdery and fibrous is disposed as an intermediate layer, and
    step (II) for processing the nonwoven fabric to form a half-split molded article.
11. The process for producing a duct according to 10 above, further comprising step (III) for joining two half-split molded articles at their longitudinal edge portions.
12. The process for producing a duct according to 10 above,
    wherein the step (I) comprises disposing an adsorbent and a second fiber-integrated body successively on a first fiber-integrated body, and bonding the first fiber-integrated body and the second fiber-integrated body.
13. The process for producing a duct according to 12 above,
    wherein a mass per unit area of the first fiber-integrated body is less than a mass per unit area of the second fiber-integrated body.
14. The process for producing a duct according to 13 above,
    wherein a ratio of the mass per unit area of the first fiber-integrated body to the mass per unit area of the second fiber-integrated body is in the range from 0.025 to 0.5.
15. The process for producing a duct according to 10 above,
    wherein the step (I) comprises disposing an adsorbent on a continuous filament web and collapsing the filament web to bond.

16. The process for producing a duct according to 10 above, wherein the step (I) comprises mixing an adsorbent into an intermediate layer of a filament web and bonding the filament web.

17. The process for producing a duct according to 10 above, wherein the adsorbent comprises an activated carbon.

Effect of the Invention

According to the duct of the present invention, the duct body is comprised of a nonwoven fabric in which an adsorbent in at least one type among granular, powdery and fibrous is disposed as an intermediate layer, and the duct body has permeability so that an adsorbable substance is adsorbed by the adsorbent, whereas an adsorbed substance is desorbed by an outdoor air flowing through the constituent fibers of the duct body. Additionally, occurrences of a noise at a time of intake and a dropping-out of an adsorbent due to a long-term use may be suppressed. Further, a constituent fiber that is located on an inner circumferential side of the duct body and a constituent fiber that is located on an outer circumferential side of the duct body are strongly bonded through a gap of the adsorbent and/or the adsorbent itself. In addition, it is possible to incorporate the adsorbent into the duct body simultaneously with forming of the duct body. As a result, a duct having a simple structure and capable of producing easily can be provided.

Moreover, in the case where the above-mentioned duct body has a first fiber layer and a second fiber layer and an adsorbent, the first fiber layer that is located on an inner circumferential side of the duct body and the second fiber layer that is located on an outer circumferential side of the duct body are strongly bonded through a gap of the adsorbent and/or the adsorbent itself.

Additionally, in the case where a mass per unit area of a first fiber-integrated body constituting the first fiber layer is less than a mass per unit area of a second fiber-integrated body constituting the second fiber layer, aeration to the first fiber layer is easy to improve an adsorptivity since the first fiber layer has a low density and the second fiber layer has a high density. Furthermore, the discharge of the desorbed substance from the second fiber layer to the outside of the duct body can be suppressed more reliably, and at the same time, it is possible to ensure a necessary and sufficient rigidity of the duct body.

Moreover, in the case where the above-mentioned adsorbent is an activated carbon, a duct body having a simpler and less expensive structure can be obtained.

In the case the duct is an intake duct that admits an outdoor air into an air cleaner for a vehicle, a fuel vapor (hydrocarbon) passed through the first fiber layer may be adsorbed by the adsorbent when the vehicle engine is stopped. And the fuel vapor temporarily adsorbed and held is desorbed due to a flow of the outdoor air passing through the first and second fiber layers into the duct body when the engine is being driven, and the fuel vapor flows to the carburetor along with the outdoor air.

According to the production process for the duct of the present invention, a nonwoven fabric in which an adsorbent in at least one type among granular, powdery and fibrous is disposed as an intermediate layer is at first obtained in the step (I), and then processing of the nonwoven fabric gives a half-split molded article in the step (II). Subsequently, two half-split molded articles are subjected to joining and the like to obtain a duct comprising a duct body in tubular in the step (III). Regarding the resultant duct, since the duct body is comprised of a nonwoven fabric in which an adsorbent in at least one type among granular, powdery and fibrous is disposed as an intermediate layer, the duct body has permeability so that an adsorbable substance is adsorbed by the adsorbent, whereas an adsorbed substance is desorbed by an outdoor air flowing through the constituent fibers of the duct body. Additionally, occurrences of a noise at a time of intake and a dropping-out of an adsorbent due to a long-term use may be suppressed. Further, a constituent fiber that is located on an inner circumferential side of the duct body and a constituent fiber that is located on an outer circumferential side of the duct body are strongly bonded through a gap of the adsorbent and/or the adsorbent itself. In addition, it is possible to incorporate the adsorbent into the duct body simultaneously with forming of the duct body. As a result, a duct having a simple structure and capable of producing easily can be provided.

Additionally, in the case where the step (I) comprises disposing an adsorbent and a second fiber-integrated body successively on a first fiber-integrated body, and bonding the first fiber-integrated body and the second fiber-integrated body, the nonwoven fabric may be easily manufactured.

Further, in the case where a mass per unit area of the first fiber-integrated body is less than a mass per unit area of the second fiber-integrated body, aeration to the first fiber layer is easy to improve an adsorptivity since the first fiber layer which is located on an inner circumferential side of the duct body and is composed of the first fiber-integrated body has a low density and the second fiber layer which is located on an outer circumferential side of the duct body and is composed of the second fiber-integrated body has a high density. Furthermore, the discharge of the desorbed substance from the second fiber layer to the outside of the duct body can be suppressed more reliably, and at the same time, it is possible to ensure a necessary and sufficient rigidity of the duct body.

Moreover, in the case where the step (I) comprises disposing an adsorbent on a continuous filament web and collapsing the filament web to bond, the nonwoven fabric may be easily manufactured.

In addition, in the case where the step (I) comprises mixing an adsorbent into an intermediate layer of a filament web and bonding the filament web, the nonwoven fabric may be easily manufactured.

DESCRIPTION OF REFERENCE NUMERALS AND SIGNS

Figure 1:
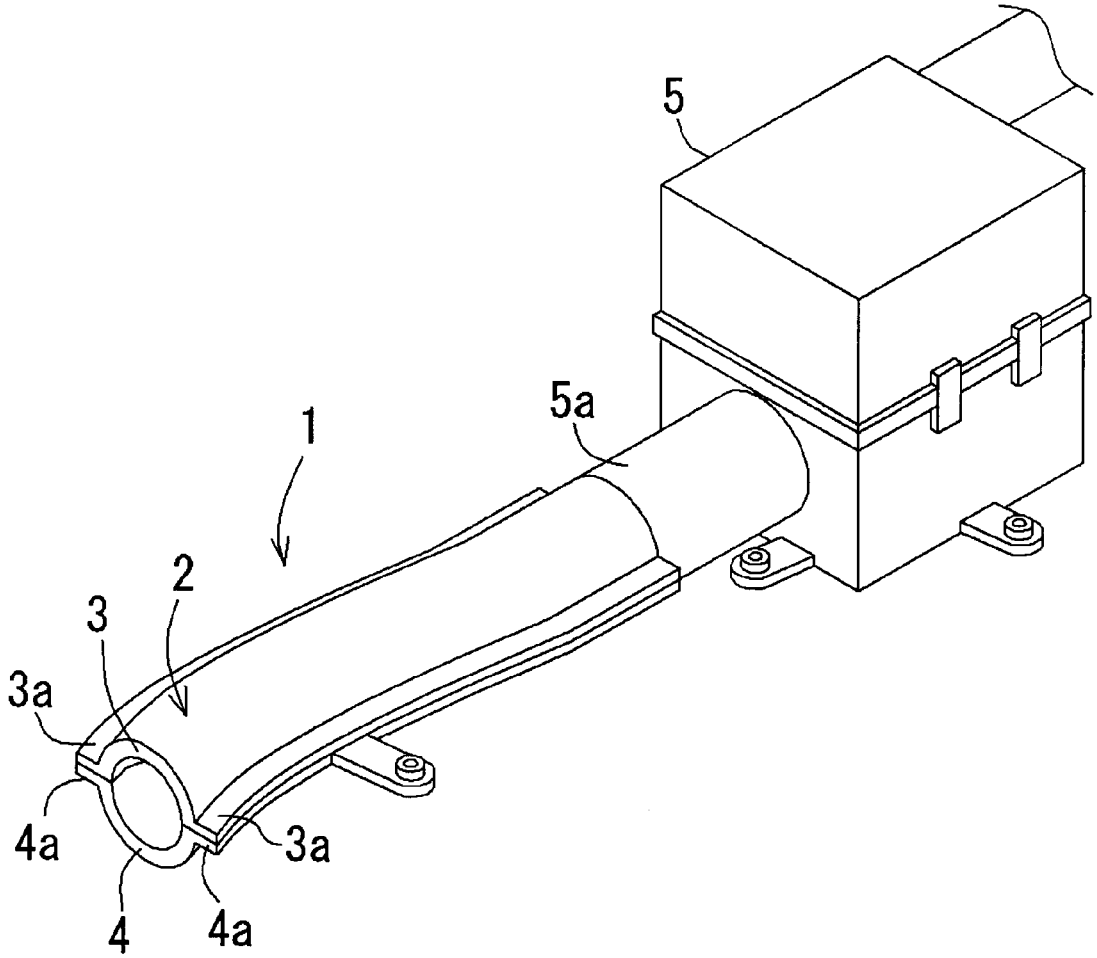
FIG. 1 is a perspective view showing a state in which the intake duct according to Example is connected to an air cleaner.

1; intake duct, 2; duct body, 5; air cleaner, 7; first fiber layer, 8; second fiber layer, 10; activated carbon, 11; first nonwoven base fabric, 12; second nonwoven base fabric, 13; laminated sheet, 13'; nonwoven fabric, 15; half-spilt molded article, 16; mold, 21; first filament web, 22; second filament web, 23; laminated sheet, 23'; nonwoven fabric.

DETAILED DESCRIPTION OF THE PREFERRED EMBODIMENTS

1. Duct

The duct of the present invention comprises a duct body in tubular and generally this duct body and other member such as locking member.

Usage, function and the like of the duct of the present invention are not particularly limited. This duct can be used for adsorption, for example, of a toxic contaminant material and an unpleasant odor. In particular, this duct can be advantageously used as an intake duct that admits an outdoor air into an air cleaner for a vehicle.

Shape, size and the like of the above-mentioned duct body are not particularly limited so long as it is comprised of a nonwoven fabric in which an adsorbent in at least one type among granular, powdery and fibrous is disposed as an intermediate layer.

Type, particle diameter, fiber length and the like of the above-mentioned adsorbent are not particularly limited.

Example of the above-mentioned adsorbent includes activated carbon; zeolite such as hydrophobic zeolite; silica gel; alumina; and the like. Among these, activated carbon, which is relatively inexpensive and is widely used, is preferred. In terms of efficiency of adsorption, a granular activated carbon is particularly preferable. The particle diameter of this granular activated carbon is preferably in the range from 0.1 to 5 mm and more preferably from 0.5 to 3 mm. In addition, in terms of retentivity of the adsorbent against the nonwoven fabric, the preferred is one in fibrous.

Production process, material and the like of the above-mentioned nonwoven fabric are not particularly limited.

Example of the production process of the above-mentioned nonwoven fabric includes a method [1] comprising disposing an adsorbent and a second fiber-integrated body successively on a first fiber-integrated body, and then bonding the first fiber-integrated body and the second fiber-integrated body (refer to FIG. 3 and FIG. 6); a method [2] comprising disposing an adsorbent on a continuous filament web, collapsing the filament web and bonding; a method [3] comprising mixing an adsorbent into an intermediate layer of a filament web and bonding the filament web; and the like.

Example of formation process of the filament web in the above-mentioned methods [2] and [3] includes a dry-process method in which short fibers are arranged in one direction or randomly by using a carding machine or air laying to form a filament web; a wet-process method in which short fibers dispersed in a water are spread on a net to form a filament web; a spunbond method in which continuous long fibers are used; and the like.

In the case each of a fiber-integrated body and a filament web is bonded, (a) a thermal bonding method comprising a contact-bonding with a heated roller when a material constituting the fiber-integrated body and a filament web has a low fusion point; (b) a chemical bonding method comprising bonding with an adhesive resin; (c) a needle punch method in which fibers are twisted together by projecting needles into the fibers; (d) a stitch bonding method in which the fibers are sewn by a thread; (e) a spunlace method in which the fibers are entangled by a high pressure water flow; and the like.

In the above-mentioned method [1], nonwoven base fabrics 11 and 12 (refer to FIG. 3 or the like), filament webs 21 and 22 (refer to FIG. 6 or the like) and the like may be used as the first and second fiber-integrated bodies, respectively.

In the above-mentioned method [1], an adsorbable nonwoven fabric consisting of a fibrous adsorbent may be disposed on the first fiber-integrated body instead of disposing the adsorbent on the first fiber-integrated body.

In the above-mentioned method [2], continuous filament web is subjected to folding back in an oblique direction toward a direction that intersects the feed direction on a feed conveyor by a cross-layer, and then the above-mentioned adsorbent is supplied into the oblique-laminated filament. If a filament web consisting of a raw fiber having a different mass per unit area in width direction in such a case, a mass per unit area of the first fiber-integrated body can be less than a mass per unit area of the second fiber-integrated body, as explained below.

In the above-mentioned method [3], when a continuous filament web is formed by feeding short fibers in an air stream with an air lay, the above-mentioned adsorbent described above may be mixed into the intermediate layer of this filament web and held.

The above-mentioned duct body is preferably one comprising a first fiber layer located on an inner circumferential side, a second fiber layer located on an outer circumferential side, and an adsorbent disposed between the first fiber layer and the second fiber layer and particularly an integrated article of half-split molded articles consisting of the above-mentioned first fiber layer, second fiber layer and adsorbent. Additionally, this duct body may be further provided with, for example, a third fiber layer as described below.

Thickness, fiber density and type of the above-mentioned first fiber layer are not particularly limited so long as it is disposed on the inner circumferential side. The thickness of the first fiber layer is preferably in the range from 1 to 10 mm and more preferably from 1.5 to 5 mm. In addition, the first fiber-integrated body constituting the above-mentioned first fiber layer may be a nonwoven base fabric, a filament web and the like.

Thickness, fiber density and type of the above-mentioned second fiber layer are not particularly limited so long as it is disposed on the outer circumferential side. The thickness of the second fiber layer is preferably in the range from 1 to 10 mm and more preferably from 1.5 to 5 mm. In addition, the second fiber-integrated body constituting the above-mentioned second fiber layer may be a nonwoven base fabric, a filament web and the like.

Types of the first fiber-integrated body constituting the first fiber layer and the second fiber-integrated body constituting the second fiber layer may be same, however, the mass per unit area of the first fiber-integrated body is preferably set to a value that is less than the mass per unit area of the second fiber-integrated body. Specifically, ratio (S1/S2) of the mass per unit area S1 of the first fiber-integrated body to the mass per unit area S2 of the second fiber-integrated body is preferably less than 1 and more preferably in the range from 0.025 to 0.5. When the ratio is low, aeration to the first fiber layer is easy to improve an adsorptivity and the discharge of a desorbed substance from the second fiber layer to the outside of the duct body can be suppressed more reliably, and further at the same time it is possible to ensure a necessary and sufficient rigidity of the duct body.

It is noted that the mass per unit area means the weight of the fiber per unit of surface area.

The mass per unit area of the above-mentioned first fiber-integrated body is preferably in the range from 50 to 1,000 g/m$^2$ and more preferably from 150 to 500 g/m$^2$. The first fiber-integrated body having the mass per unit area of the above range is suitable for permeating of an adsorbable substance.

Additionally, the mass per unit area of the above-mentioned second fiber-integrated body is preferably in the range from 100 to 2,000 g/m$^2$ and more preferably from 300 to 1,500 g/m$^2$. The above range leads to a second fiber-integrated body which is suitable for impermeating of an adsorbable substance and is showing a necessary and sufficient rigidity.

Thickness, fiber density and type of the above-mentioned third fiber layer are not particularly limited so long as it is disposed on the outer circumferential side of the second fiber layer. The thickness of the third fiber layer is preferably in the range from 1 to 5 mm and more preferably from 2 to 3 mm. In addition, the third fiber-integrated body constituting the above-mentioned third fiber layer may be a nonwoven base fabric, a filament web and the like.

Type of the third fiber-integrated body may be selected depending on types of the first and second fiber-integrated bodies, however, the mass per unit area of the above-mentioned third fiber-integrated body is preferably in the range from 1,000 to 3,000 g/m$^2$ and more preferably from 1,500 to 2,000 g/m$^2$ in terms of impermeability of an adsorbable substance and rigidity.

Example of a material constituting a raw fiber of the above-mentioned nonwoven fabric includes polyester, polypropylene, rayon, glass, acate and the like.

The above-mentioned nonwoven fabric may be one consisting of a raw fiber and a binder of a thermoplastic resin and may be specifically one in which the raw fiber is impregnated with the binder of a thermoplastic resin, one in which a raw fiber and a fiber of a thermoplastic resin as a binder are mixed and the like. Example of a material constituting the raw fiber includes polyester, polypropylene, rayon, glass, acate and the like. In addition, example of the binder of a thermoplastic resin includes a fiber consisting of a low-melting point resin coated polyester, polypropylene, rayon, glass, acate and the like. Modified polyester, modified polyethylene, modified polypropylene and the like may be used as the resin having a low melting point.

The above-mentioned nonwoven fabric may be one having a density gradient in one or both of the thickness directions of the raw fiber and/or the binder of a thermoplastic resin.

2. Process for Producing a Duct

The process for producing a duct of the present invention is a producing method of a duct comprising a duct body in tubular and comprises a step (I) for obtaining a nonwoven fabric in which an adsorbent in at least one type among granular, powdery and fibrous is disposed as an intermediate layer, and a step (II) for processing the nonwoven fabric to form a half-split molded article successively. The process for producing a duct of the present invention may further comprise a step (III) for joining two half-split molded articles at their longitudinal edge portions.

The process for producing a duct of the present invention may be a method in which the above-mentioned duct as explained above is subjected to production. Additionally, regarding fiber-integrated bodies, adsorbent and nonwoven fabric that is described below, the structures as explained above may be applied as it is.

Process, procedure and the like of the above-mentioned step (I) are not particularly limited so long as it is one for obtaining a nonwoven fabric in which an adsorbent in at least one type among granular, powdery and fibrous is disposed as an intermediate layer. The production process of the nonwoven fabric may be applied to above-mentioned methods [1] to [3] as explained.

According to the step (I), after disposing an adsorbent and a second fiber-integrated body successively on a first fiber-integrated body or after disposing further a third fiber-integrated body on this laminate, bonding of the above-mentioned first and second fiber-integrated bodies or first to third fiber-integrated bodies are carried out to a nonwoven fabric.

Figure 5:
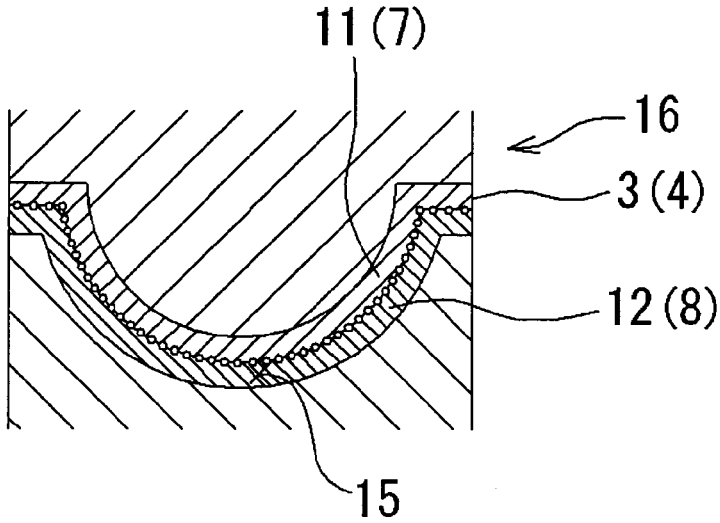
FIG. 5 is a transverse cross-sectional view of a half-split molded article in a mold.

Process, procedure and the like of the above-mentioned step (II) are not particularly limited so long as it is one for processing the nonwoven fabric obtained by the above step (I) to form a half-split molded article. In the step (II), the above-mentioned nonwoven fabric is set to a mold leading to a half-split molded article and is subjected to mold clamping for obtaining a half-split molded article in semicircular, as shown in FIG. 5.

When the above-mentioned half-split molded article is manufactured, hot pressing (compression molding) and the like are conducted. Heating temperature and compression rate in this hot pressing may be suitably selected.

Process, procedure and the like of the above-mentioned step (III) are not particularly limited so long as it is one for joining two half-split molded articles at their longitudinal edge portions. The above-mentioned duct can be obtained by this step (III).

When the bonding of the half-split molded articles is conducted, hot pressing (compression molding), needle punching, welding, adhesion and the like are may be applied singly or in combination of two or more. Heating temperature and compression rate in this hot pressing may be suitably selected.

Embodiment

The present invention will be described in detail hereinafter using examples with some drawings.

In the present Example given here, an air intake duct constituting an air intake system of an automobile engine is exemplified as the "duct" of the present invention.

(1) Structure of the Intake Duct

The intake duct 1 is provided with a tubular duct body 2 as shown in FIG. 1. This duct body 2 is formed by using same two half-split molded articles 3 and 4 whose shape of transverse cross-section is semicircular and bonding flange portions 3*a* and 4*a* of them.

The distal end side of the intake duct 1 is connected to a cylindrical portion 5*a* for connecting of an air cleaner 5.

Figure 2:
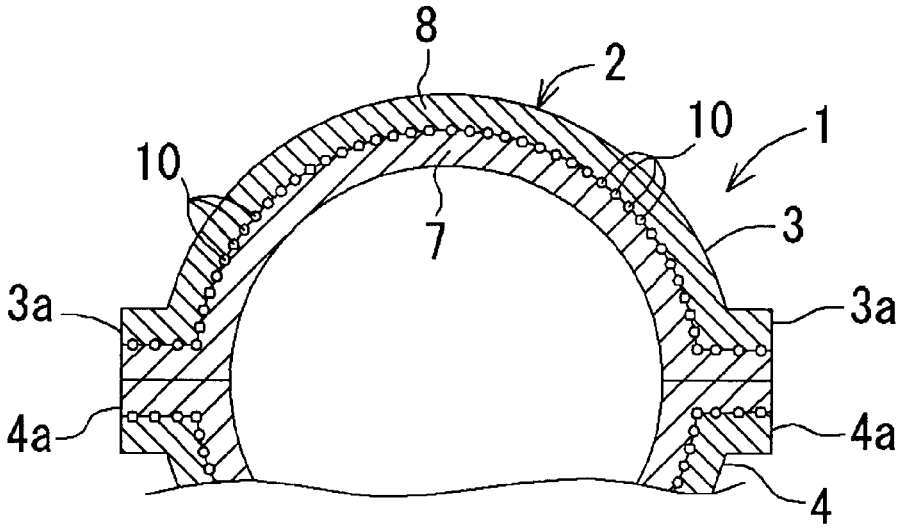
FIG. 2 is a transverse cross-sectional view of the intake duct according to Example.

The above-mentioned duct body 2 consists of a first fiber layer 7 that is located on an inner circumferential side of the duct body 2 and is made from a first nonwoven base fabric described below, a second fiber layer 8 that is located on an outer circumferential side of the duct body 2 and is made from a second nonwoven base fabric described below, and a granular activated carbon 10 that is disposed between the first fiber layer 7 and the second fiber layer 8, as shown in FIG. 2. The thickness of the first fiber layer 7 is set to approximately 2 mm, and the thickness of the second fiber layer 8 is set to approximately 2 mm. In addition, the average particle diameter of the activated carbon 10 is set to approximately 1 mm.

(2) Manufacturing Method for the Intake Duct

Hereinafter, a manufacturing method for the above-mentioned intake duct is explained.

For the purpose of manufacturing the above-mentioned intake duct, the first nonwoven base fabric 11 (illustrated as an example of the "first fiber-integrated body" according to the present invention) having a mass per unit area of 500 g/m$^2$ is used. And the second nonwoven base fabric 12 (illustrated as an example of the "second fiber-integrated body" according to the present invention) having a mass per unit area of 1,000 g/m$^2$ is used.

The first nonwoven base fabric 11 and second nonwoven base fabric 12 are ones obtained by formulating a raw fiber such as polyester fiber into a thermoplastic resin binder (for example, polyester fibers that are coated with a modified polyester or the like) to mix.

Figure 3:
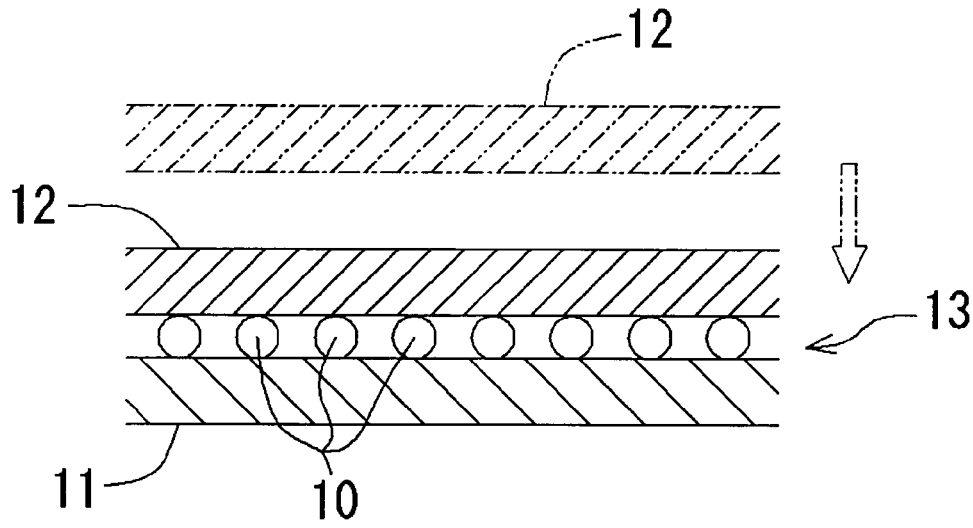
FIG. 3 is a transverse cross-sectional view of a laminated sheet before forming a nonwoven fabric.
Figure 4:
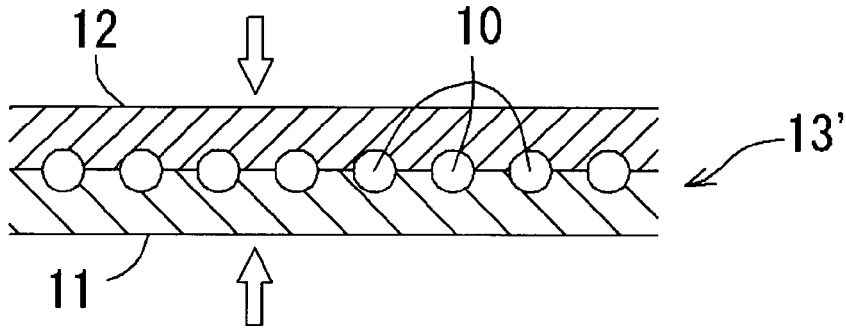
FIG. 4 is a transverse cross-sectional view of the nonwoven fabric according to Example.

First, a granular activated carbon 10 is supplied and disposed on an upper surface of the first nonwoven base fabric 11, and then the second nonwoven base fabric 12 is laminated on the upper surface of this first nonwoven base fabric 11 to form a sheet-like laminated sheet 13, as shown in FIG. 3. Subsequently, this laminated sheet 13 is subjected to a provisional molding (hot pressing) to obtain a nonwoven fabric 13' in which the activated carbon 10 is disposed as an intermediate layer, as shown in FIG. 4. At this time, the first nonwoven base fabric 11 and second nonwoven base fabric 12 are brought into contact with each other through a plurality of gaps between activated carbons 10, and thus they are bonded strongly by melting of the binder. Next, the provisionally formed nonwoven fabric 13' is set in a mold 16 leading to a half-split molded article 15, and is subjected to a main molding (hot pressing), as shown in FIG. 5. After that, two half-sections 3 and 4 obtained by this molding are bonded at the flange portions 3*a* and 4*a* to produce the intake duct 1.

(3) Manufacturing Method for other Intake Duct

Figure 6:
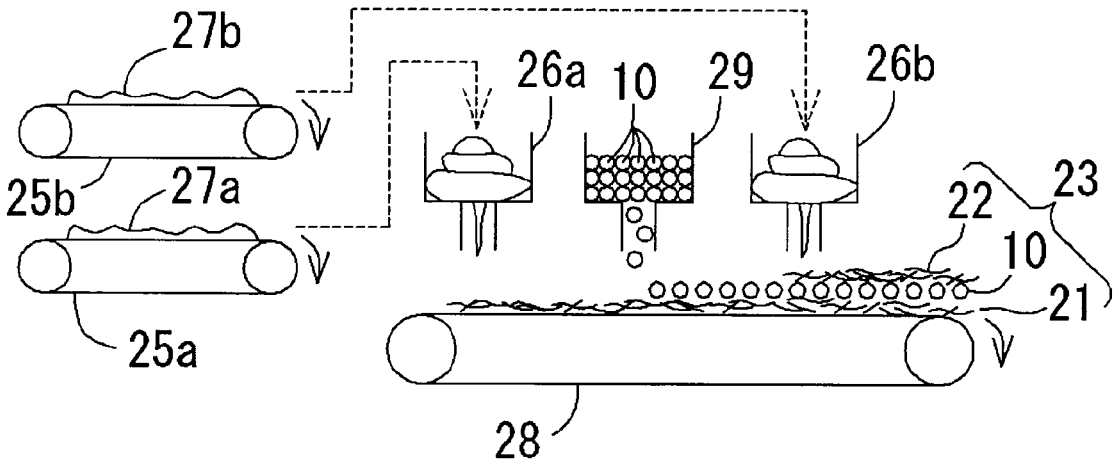
FIG. 6 is an explanatory view of another production process.

Hereinafter, a manufacturing method for other intake duct is explained using FIG. 6.

First, a first raw fiber 27*a* is supplied to an upstream side of a lamination conveyor 28 via a fiber supply apparatus 26*a* from a supply conveyor 25*a* to form a first filament web 21 (illustrated as an example of the "first fiber-integrated body" according to the present invention) having a mass per unit area of 500 g/m$^2$. Then, a granular activated carbon 10 is supplied to a midstream side of the laminating conveyor 28 by an activated carbon supply apparatus 29. After that, a second raw fiber 27*b* is supplied to downstream side of the laminating conveyor 28 via a fiber supply apparatus 26*b* from a supply conveyor 25*b* to form a second filament web 22 (illustrated as an example of the "second fiber-integrated body" according to the present invention) having a mass per unit area of 1,000 g/m$^2$. As a result, a web-like laminating sheet 23 is formed in which a granular activated carbon 10 is disposed between the first filament web 21 and the second filament web 22.

It is noted that a thermoplastic resin binder is mixed into the above-mentioned first raw fiber 27*a* and second raw fiber 27*b*.

Figure 7:
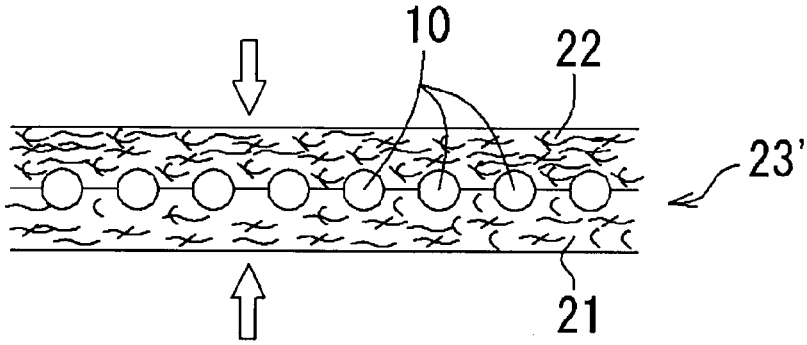
FIG. 7 is a transverse cross-sectional view of the nonwoven fabric according to Example.

Subsequently, the laminated sheet 23 is subjected to a provisional molding (hot pressing) to obtain a nonwoven fabric 23' in which the activated carbon 10 is disposed as an intermediate layer, as shown in FIG. 7. At this time, the first filament web 21 and the second filament web 22 are brought into contact with each other through a plurality of gaps between activated carbons 10, and thus they are bonded strongly by melting of the binder. After that, the provisionally formed nonwoven fabric 23' is subjected to a main molding (hot pressing) with a mold 16 as shown in FIG. 5, in the same manner as the method in (2) above, and finally two half-sections 3 and 4 obtained by this molding are bonded to produce the intake duct 1.

(4) Effects of the Embodiments

Since the duct body 2 in which a granular activated carbon 10 is disposed between the first fiber layer 7 and the second fiber layer 8 so as to have a prescribed permeability in the present embodiments, a fuel vapor (hydrocarbon) passed through the first fiber layer 7 is adsorbed by the activated carbon 10 when the engine is stopped, whereas the adsorbed and kept fuel vapor once onto the activated carbon 10 is desorbed to a carburetor side with an outdoor air into the duct body 2 flowing through the first fiber layer 7 and the second fiber layer 8 when the engine is running. Additionally, since the duct body 2 has permeability, an occurrence of a noise at a time of intake may be suppressed. Further, since the granular activated carbon 10 is strongly retained between the first and second fiber layers 7 and 8, an occurrence of a dropping-out of the activated carbon 10 from the duct body 2 due to a long-term use may be suppressed. Moreover, since the first fiber layer 7 and the second fiber layer 8 are strongly bonded by being brought into contact with each other through the gaps in the granular activated carbon 10, the resultant duct has a simple structure in comparison to ones using a wire. In addition, the present duct may have a compact and simple structure in comparison with a conventional one having a container accommodating a fiber layer for adsorbing attached to an outer circumferential side of the duct body.

Further, since the mass per unit area of the first nonwoven base fabric 11 (or the first filament web 21) is set to a value that is less than the mass per unit area of the second nonwoven basic fabric 12 (or the second filament web 22) in the present embodiments, the first fiber layer 7 which is located on an inner circumferential side of the duct body 2 has a low density and the second fiber layer 8 which is located on an outer circumferential side of the duct body 2 and aeration to the activated carbon 10 in the first fiber layer 7 may be easy to improve an adsorptivity. Additionally, the discharge of the desorbed substance from the second fiber layer 8 to the outside of the duct body 2 can be suppressed more reliably, and at the same time, it is possible to ensure a necessary and sufficient rigidity of the duct body 2.

Since a granular activated carbon 10 is interposed between the first nonwoven base fabric 11 (or the first filament web 21) and the second nonwoven base fabric 12 (or the second filament web 22) to form a laminated sheet 13 (or a laminated sheet 23) is formed, the laminated sheet 13 (or the laminated sheet 23) is provisionally molded to obtain a nonwoven fabric 13' (or a nonwoven fabric 23'), the nonwoven fabric 13' (and the nonwoven fabric 23') is set in a mold 16 to carry out the main molding, and then two half-split molded articles 3 and 4 that are obtained above are joined at their longitudinal edge portions, the activated carbon 10 can be formulated into the duct body 2, simultaneously with the molding of the duct body 2. Therefore, in comparison to the conventional case including a molding of a duct body and an attaching of a fiber layer for absorbing separately, production of a duct is easily carried out. Additionally, it is possible to handle the nonwoven fabric 13' (or the nonwoven fabric 23') easily as a flat integrated body after provisional molding.

In the case in which nonwoven fabrics 11 and 12 excellent in processability are used as first and second fiber-integrated bodies, respectively, the laminated sheet 13, the nonwoven fabric 13' and the intake duct 1 can be manufactured easily.

Moreover, in the case in which the filament webs 21 and 22 are used as the first and second fiber-integrated bodies, respectively, the laminated sheet 23 can be molded directly from raw fibers, and it is possible to further improve productivity in comparison to a case of molding the laminated sheet 13 after forming the nonwoven fabrics 11 and 12 with raw fiber.

Figure 8:
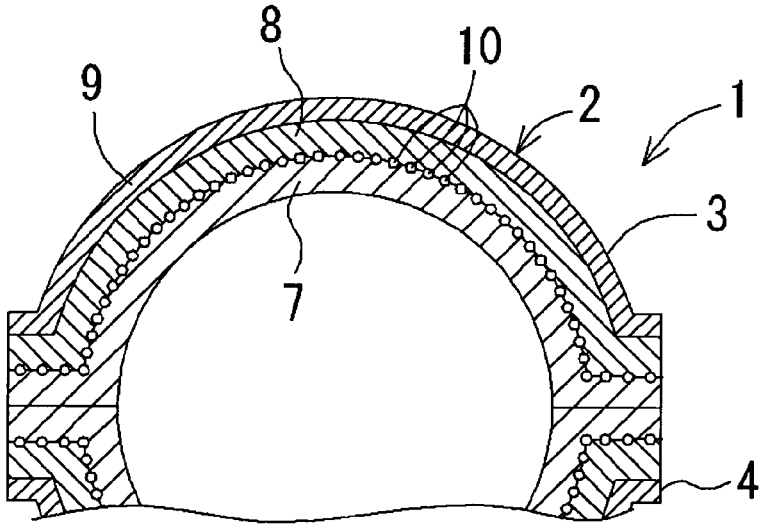
FIG. 8 is a transverse cross-sectional view of another intake duct.

The present invention is not limited to the above embodiments, and various modifications of the embodiments are possible depending on the objective or usage. Specifically, though the first fiber layer 7 and the second fiber layer 8 were used to form a duct comprising the duct body 2 in the above embodiment, the duct may be comprised of a circular third fiber layer 9 that is consisting of a third nonwoven fabric and is laminated on the outer circumferential side of the second fiber layer 8 in addition to the first fiber layer 7 and the second fiber layer 8, as shown in FIG. 8. Thereby, the discharge of a fuel vapor to the outside of the duct body 2 can be suppressed more reliably, and at the same time, it is possible to ensure a necessary and sufficient rigidity of the duct body 2. Further, one or more other fiber layers may be provided on the outer circumferential side of this third fiber layer 9. In addition, though the granular activated carbon 10 is disposed between the first fiber layer 7 and the second fiber layer 8 in the above embodiment, a layer for adsorbing consisting of a fibrous activated carbon may be disposed between the first fiber layer 7 and the second fiber layer 8.

Furthermore, though the nonwoven base fabric having almost same densities of the raw fiber and the binder are exemplified, a nonwoven having a density gradient in one or both of the thickness directions of the raw fiber and/or the binder may be used.

In addition, for the purpose of forming the laminated sheet 13, the preheated activated carbon 10 may be supplied on the first nonwoven base fabric 11 (or the first filament web 21), the second nonwoven base fabric 12 (or the second filament web 22) may be laminated on this first base fabric 11 (or the first filament web 21) to obtain a the laminated sheet 13 (or the laminated sheet 23). Thereby, melt portions at the first nonwoven base fabric 11 and the second nonwoven base fabric 12 or the first filament web 21 and the second filament web 22 that are contacting with the activated carbon 10 may lead to laminated sheets 13 and 23 as an integrated body excellent in processability.

INDUSTRIAL APPLICABILITY

The present duct can be widely used for adsorbing a toxic contaminant, an unpleasant smelling substance and the like. In particular, the present duct can be advantageously used as an intake duct that adsorbs a fuel vapor (hydrocarbons) of a vehicle.

The invention claimed is:

1. A duct comprising a duct body in tubular, wherein said duct body is comprised of a nonwoven fabric in which an adsorbent in at least one type among granular, powdery and fibrous is disposed as an intermediate layer, wherein said duct body comprises a first fiber layer that is located on an inner circumferential side of said duct body, a second fiber layer that is located on an outer circumferential side of said duct body, and said adsorbent that is disposed between said first fiber layer and said second fiber layer, and wherein a mass per unit area of a first fiber-integrated body comprising said first fiber layer is less than a mass per unit area of a second fiber-integrated body comprising said second fiber layer.

2. The duct according to claim 1, wherein a ratio of said mass per unit area of said first fiber-integrated body to said mass per unit area of said second fiber-integrated body is in the range from 0.025 to 0.5.

3. The duct according to claim 1, wherein said duct body is an integrated article of half-split molded articles consisting of said first fiber layer, said second fiber layer and said adsorbent.

4. The duct according to claim 3, wherein a mass per unit area of a first fiber-integrated body constituting said first fiber layer is less than a mass per unit area of a second fiber-integrated body constituting said second fiber layer.

5. The duct according to claim 4, wherein a ratio of said mass per unit area of said first fiber-integrated body to said mass per unit area of said second fiber-integrated body is in the range from 0.025 to 0.5.

6. The duct according to claim 1, wherein said adsorbent comprises an activated carbon.

7. The duct according to claim 1, wherein said duct is an intake duct that admits outside air into an air cleaner for a vehicle.

8. The duct according to claim 1, wherein the first fiber layer is the innermost layer of the duct.

9. The duct according to claim 1, further comprising a third fiber layer disposed on a radially outermost surface of the second fiber layer.

10. A process for producing a duct including a tubular shape, comprising successively:

step (I) for obtaining a nonwoven fabric in which an adsorbent in at least one type among granular, powdery and fibrous is disposed as an intermediate layer, and step (II) for processing said nonwoven fabric to form a half-split molded article, wherein said step (I) comprises disposing an adsorbent and a second fiber-integrated body successively on a first fiber-integrated body, and bonding said first fiber-integrated body and said second fiber-integrated body, wherein a mass per unit area of said first fiber-integrated body is less than a mass per unit area of said second fiber-integrated body.

11. The process for producing a duct according to claim 10, further comprising step (III) for joining two half-split molded articles at their longitudinal edge portions.

12. The process for producing a duct according to claim 10, wherein a ratio of said mass per unit area of said first fiber-integrated body to said mass per unit area of said second fiber-integrated body is in the range from 0.025 to 0.5.

13. The process for producing a duct according to claim 10, wherein said step (I) comprises disposing an adsorbent on a continuous filament web and collapsing said filament web to a bonded state.

14. The process for producing a duct according to claim 10, wherein said step (I) comprises mixing an adsorbent into an intermediate layer of a filament web and bonding said filament web.

15. The process for producing a duct according to claim 10, wherein said adsorbent comprises an activated carbon.

* * * * *